US009993100B2

(12) United States Patent
Tucker

(10) Patent No.: US 9,993,100 B2
(45) Date of Patent: Jun. 12, 2018

(54) VERTICALLY ADJUSTABLE GARMENT HANGER

(71) Applicant: Michael Tucker, Montrose, CO (US)

(72) Inventor: Michael Tucker, Montrose, CO (US)

( * ) Notice: Subject to any disclaimer, the term of this patent is extended or adjusted under 35 U.S.C. 154(b) by 28 days.

(21) Appl. No.: 15/265,944

(22) Filed: Sep. 15, 2016

(65) Prior Publication Data

US 2017/0071388 A1 Mar. 16, 2017

Related U.S. Application Data

(60) Provisional application No. 62/218,697, filed on Sep. 15, 2015.

(51) Int. Cl.
*A47G 25/32* (2006.01)
*A47G 25/38* (2006.01)

(52) U.S. Cl.
CPC ..... *A47G 25/32* (2013.01); *A47G 25/38* (2013.01)

(58) Field of Classification Search
CPC ..... A47G 25/0607; A47G 25/0685; A47G 25/32; A47G 25/38; A47G 2025/448
See application file for complete search history.

(56) References Cited

U.S. PATENT DOCUMENTS 958,366 A * 5/1910 Clausen ..... A47G 25/4023 223/89
1,009,522 A * 11/1911 Johnson ..... A47G 25/32 223/90
2,151,621 A * 3/1939 Silverman ..... A47G 25/24 223/88
2,747,746 A * 5/1956 Laughton ..... A47G 25/18 16/265
2,998,903 A * 9/1961 Day ..... A47G 25/14 223/68
3,010,625 A * 11/1961 Glotzer ..... A47G 25/16 206/278
3,856,190 A 12/1974 Mole et al.
4,058,222 A * 11/1977 Singer ..... A47G 25/18 211/118
4,709,838 A 12/1987 Campbell
4,730,863 A 3/1988 Guadnola
5,613,630 A 3/1997 Isenga et al.
5,971,237 A 10/1999 Timbrook
6,808,093 B1 10/2004 Lin et al.
7,128,248 B2 10/2006 Frassinelli
7,182,232 B2 2/2007 Fleming et al.
(Continued)

*Primary Examiner* — Ismael Izaguirre
(74) *Attorney, Agent, or Firm* — Global Intellectual Property Agency, LLC; Jordan Sworen

(57) ABSTRACT

A vertically adjustable garment hanger. The vertically adjustable garment hanger includes a supporting hook having a curved upper end and a lower end. The first end of a vertical suspending member is connected to the lower end of the supporting hook. An end stop is disposed on the second end of the vertical suspending member. A garment retaining body supports clothing thereon and includes an aperture. The vertical suspending member is inserted through the aperture in sliding engagement therewith. An adjustable support member is slidably disposed on the vertical suspending member. The adjustable support member allows the distance between the supporting hook and garment retaining to be changed so that users can hang clothing from a horizontal supporting rod at a desired height.

9 Claims, 3 Drawing Sheets

(56) References Cited

U.S. PATENT DOCUMENTS

| | | | |
|---|---|---|---|
| 7,832,603 | B2 | 11/2010 | Gouldson |
| 7,832,604 | B2 | 11/2010 | Gouldson |
| 8,177,106 | B2 | 5/2012 | Betts |
| 8,267,287 | B2 | 9/2012 | Gouldson |
| 8,286,842 | B2 | 10/2012 | Carey |

* cited by examiner

VERTICALLY ADJUSTABLE GARMENT HANGER

CROSS REFERENCE TO RELATED APPLICATIONS

This application claims the benefit of U.S. Provisional Application No. 62/218,697 filed on Sep. 15, 2015. The above identified patent application is herein incorporated by reference in its entirety to provide continuity of disclosure.

FIELD OF THE INVENTION

The present invention relates to garment hangers. More specifically, the present invention provides a vertically adjustable garment hanger configured to support various sizes and styles of clothing at selective heights.

BACKGROUND OF THE INVENTION

Common garment hangers are often used to support clothing in a raised position along a horizontal rod, such as those typically found in a closet. Common garment hangers typically consist of a unitary, fixed structure that is hung from the horizontal rod via a supporting hook, while clothing is supported on a lower portion of the garment hanger. The horizontal supporting rods utilized for clothing storage are usually fixed between sixty and sixty-six inches from the floor. People of short stature, children, handicapped, or otherwise injured individuals may have difficulty reaching for a garment hung at this height. Injured individuals may experience pain in their joints or dizziness when reaching for the garment. If a small child cannot reach a hanging garment, the child will often grab the bottom of the garment and forcefully pull it off of the garment hanger. This can cause damage to the clothing, the hangers, or the horizontal support rod. Further, individuals who are short of stature may need to utilize a step ladder or chair to reach the garment, which poses an inconvenience and a potential safety hazard. Additionally, handicapped individuals may have no means of reaching a garment hanging at standard heights. There is a need for a height adjustable hanger to allow aforementioned individuals to easily reach and retrieve hanging clothing.

For many individuals, it is important to maintain an efficient and organized closet space. Standard garment hangers store garments at a standard height in relation to one another. When all garments are stored on the same horizontal support rod, the width of the storage space within the closet is limited. The efficiency of the storage space is reduced because the space beneath the bottom of the hanging garments and the floor is left unused for storage. It is also less aesthetically pleasing to hang garments at a universal height on the same horizontal support rod as opposed to matching top garments such as shirts to bottom garments such as pants.

Adjustable garment hangers exist in the prior art. However, these prior art devices have several known drawbacks. Some prior art devices provide garment hangers that are adjustable in size, but these devices include many interchangeable parts and components, which requires the user to expend unnecessary time and effort to reconfigure the garment hanger. Other prior art devices provide series of complicated hooks that can be secured to one another, but these devices are unable to function as typical garment hangers having a swiveling supporting hook, which may be desirable for providing a uniform and aesthetically pleasing storage space. Still, other prior art garment hangers have expanding attachments that allow for multiple articles to be hung from one hanger in the name of efficiency and organization, but do not allow for vertical adjustment of the hanger to control the height of the stored article of clothing for accessibility purposes.

In light of the drawbacks of prior art garment hangers, it is submitted that the present invention substantially diverges in design elements from the prior art and consequently it is clear that there is a need in the art for an improvement to existing garment hangers. In this regard, the present invention substantially fulfills these needs.

SUMMARY OF THE INVENTION

In view of the foregoing disadvantages inherent in the known types of garment hangers now present in the prior art, the present invention provides a vertically adjustable garment hanger wherein the same can be utilized for providing convenience for the user when hanging clothing of various style and sizes. The vertically adjustable garment hanger includes a supporting hook having a curved upper end and a lower end, a vertical suspending member having a first end and a second end, wherein the first end is connected to the lower end of the supporting hook, and an end stop disposed on the second end of the vertical suspending member. The vertically adjustable garment hanger further includes a garment retaining body having an upper angled end with an aperture thereon, wherein the vertical suspending member is inserted through the aperture in sliding engagement therewith, and an adjustable support member slidably disposed on the vertical suspending member between the end stop and the aperture, wherein the vertical suspending member is sized so as to be unable to fit through a lower opening of the aperture.

One object of the present invention is to provide a vertically adjustable garment hanger having all of the advantages of prior art garment hangers and none of the disadvantages.

Another object of the present invention is to provide a vertically adjustable garment hanger that allows individuals to store garments at a desired height for easy accessibility.

A further object of the present invention is to provide a vertically adjustable garment hanger whose height can be quickly and easily adjusted via selective movement of a sliding adjustable support member.

Yet another object of the present invention is to provide a vertically adjustable garment hanger that allows individuals to make efficient use of a storage space.

Still a further object of the present invention is to provide a vertically adjustable garment hanger that is capable of functioning as a normal swivel hanger.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
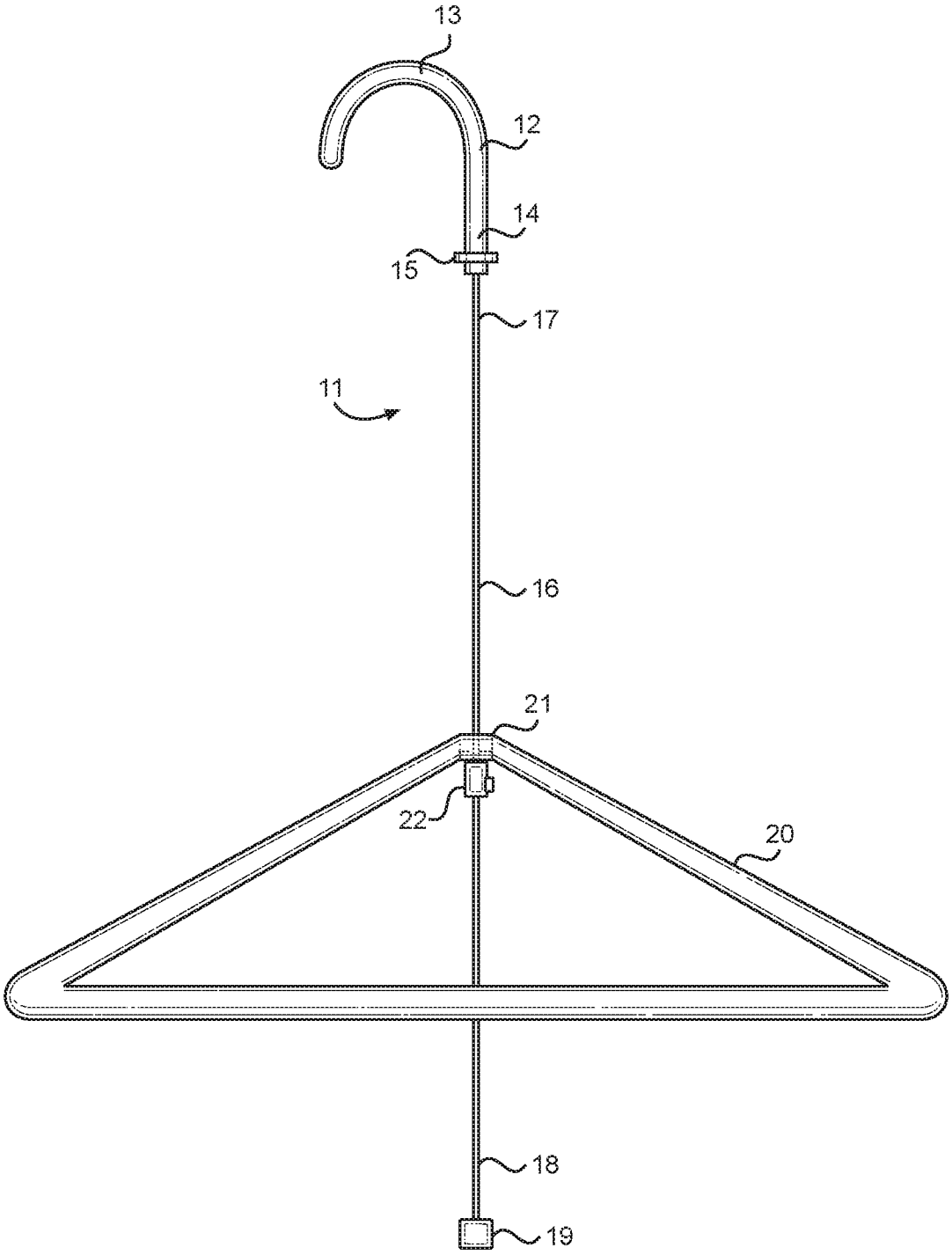
FIG. 1 shows a side view of a vertically adjustable garment hanger according to the present invention.

Reference is made herein to the attached drawings. Like reference numerals are used throughout the drawings to depict like or similar elements of the vertically adjustable garment hanger. For the purposes of presenting a brief and clear description of the present invention, the preferred embodiment will be discussed as used for hanging garments along a horizontal supporting rod, such as those typically found in a closet. The figures are intended for representative purposes only and should not be considered to be limiting in any respect.

Referring now to FIG. 1, there is shown a side view of a vertically adjustable garment hanger according to the present invention. The vertically adjustable garment hanger 11 generally comprises a supporting hook 12 having a lower end 14 and a curved upper end 13. The curved upper end 13 is configured to rest on a horizontal supporting rod, such as those typically found in a closet or other clothing storage space, in order to support the vertically adjustable garment hanger 11 in a raised position within the storage space.

The adjustable garment hanger 11 further comprises a vertical suspending member 16 having a first end 17 and a second end 18. The first end 17 of the vertical suspending member 16 is connected to the lower end 14 of the supporting hook 12. An end stop 19 is disposed on the second end 18 of the vertical suspending member 16. A garment retaining body 20 is slidably disposed along the vertical suspending member 16. The garment retaining body 20 is preferably triangular in shape, having a lower horizontal member and a pair of opposing angled members that connect to form an upper portion 21. The garment retaining body 20 is configured to support a variety of clothing types thereon, such as shirts, pants, jackets, and the like.

An adjustable support member 22 is slidably disposed along the vertical suspending member 16 between the upper portion 21 of the garment retaining body 20 and the end stop 19. The adjustable support member 22 is configured to support the garment retaining body 20 at a selective distance from the supporting hook 12. The end stop 19 prevents the adjustable support member 22 from being detached from the vertical suspending member 16.

Figure 2A:
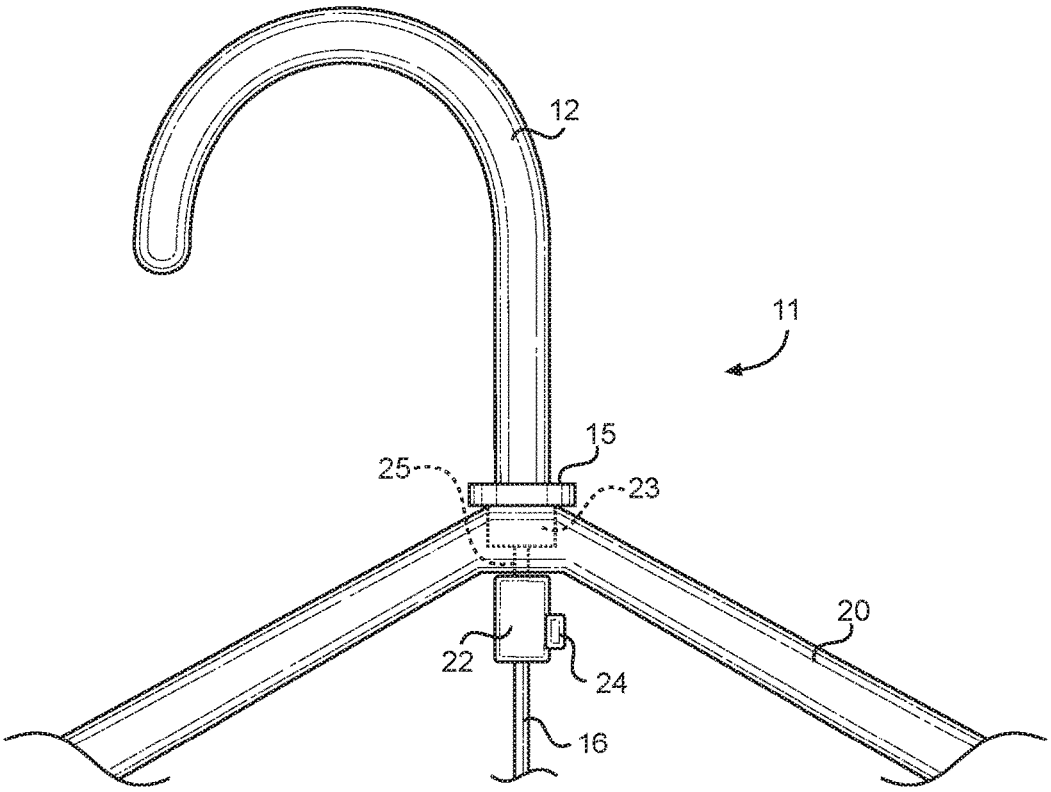
FIG. 2A shows an alternate side view of vertically adjustable garment hanger according to the present invention.
Figure 2B:
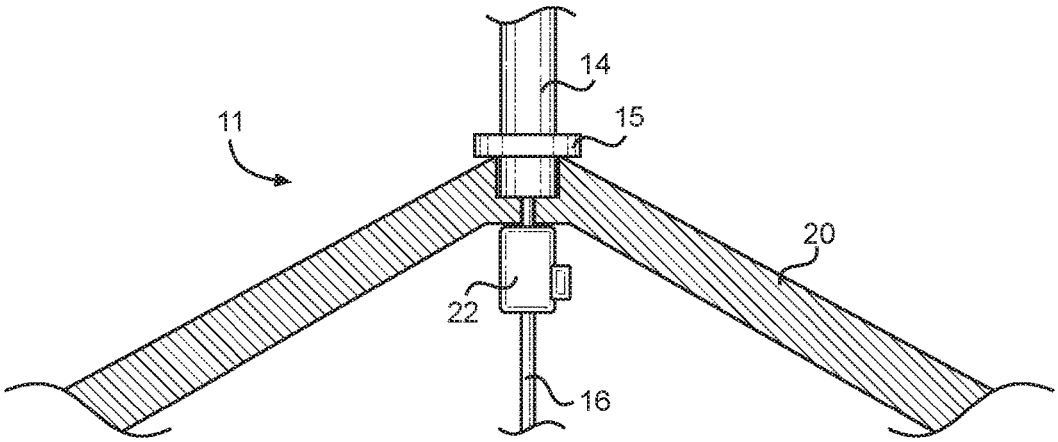
FIG. 2B shows a cross-sectional view of a vertically adjustable garment hanger according to the present invention.

Referring now to FIGS. 2A and 2B, there is shown an alternate side view and a cross-sectional view of a vertically adjustable garment hanger according to the present invention, respectively. The garment retaining body 20 comprises an aperture 25 disposed on the upper portion thereof, through which the vertical suspending member 16 is inserted. The upper portion of the garment retaining body 20 comprises a notch 23 thereon. The notch 23 is sized to receive the lower end 14 of the supporting hook 12.

A flange 15 is disposed on the lower end 14 of the supporting hook 12. When in a fully retracted position as shown, the flange 15 contacts the garment retaining body 20 on either side of the notched portion 23. The supporting hook 12 is able to freely swivel 360 degrees with respect to the garment retaining body 20. In this way, the vertically adjustable garment hanger 11 is also capable of functioning as a typical swivel hanger if the user so desires. The swiveling function allows the vertically adjustable garment hanger 11 to be supported on irregular surfaces such as, for example, the back of a chair or the top of a door.

The adjustable support member 22 is shown supporting the garment retaining body 20. The adjustable support member 22 may vary in size, but is at least large enough so as to be unable to pass through the aperture 25 of the garment retaining body 20. In one embodiment of the invention, the adjustable support member 22 comprises a spring biased button 24 that permits movement of the adjustable support member 22 when depressed by the user. When not depressed, the spring biased button 24 prevents movement of the adjustable support member 22 along the vertical suspending member 16 and supports the garment retaining body 20 thereon.

Figure 3:
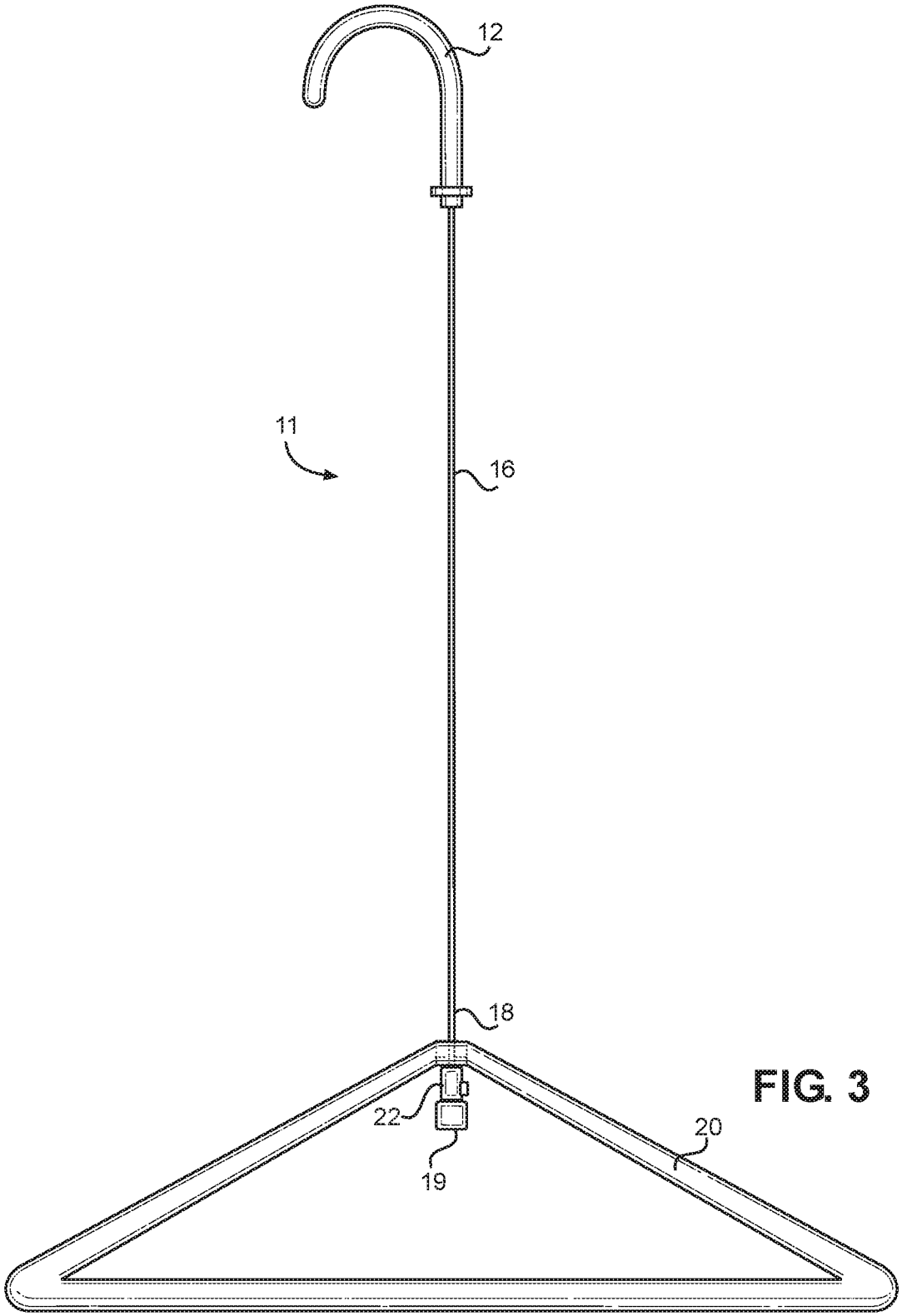
FIG. 3 shows a side view of a vertically adjustable garment hanger according to the present invention in a fully extended position.

Referring now to FIG. 3, there is shown a side view of a vertically adjustable garment hanger according to the present invention in a fully extended position, with the maximum distance between the supporting hook 12 and the garment retaining body 20. When fully extended, the vertically adjustable garment hanger 11 allows users to store clothes at a height at which the clothing is easily accessible, in this position, the adjustable support member 22 is supported by the end stop 19.

The materials from which the vertically adjustable garment hanger 11 is formed may include, but are not limited to, plastic, wood, metal, or any combinations thereof. Additionally, the vertical suspending member 16 may be a flexible cord in one embodiment of the invention, or may be a rigid rod in an alternate embodiment of the invention. The exact size and material properties of the vertically suspending garment hanger may vary during manufacturing.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vertically adjustable garment hanger comprising:

a supporting hook having a curved upper end and a lower end;

a vertical suspending member having a first end and a second end, wherein the first end is connected to the lower end of the supporting hook;

an end stop disposed on the second end of the vertical suspending member;

a garment retaining body having an upper angled end with an aperture thereon, wherein the vertical suspending member is inserted through the aperture in sliding engagement therewith;

a notched portion disposed on the garment retaining body above the aperture, wherein the notched portion is sized to receive the lower end of the supporting hook therein; and an adjustable support member slidably disposed on the vertical suspending member between the end stop and the aperture, wherein the adjustable support member is sized so as to be unable to pass through the aperture.

2. The vertically adjustable garment hanger of claim 1, further comprising a flange on the lower end of the supporting hook, wherein the flange contacts the garment retaining body when the vertically adjustable garment hanger is in a fully retracted position.

3. The vertically adjustable garment hanger of claim 1, wherein the flange contacts the garment retaining body when the lower end of the supporting hook is received by the notched portion.

4. The vertically adjustable garment hanger of claim 1, wherein the vertical suspending member is flexible.

5. The vertically adjustable garment hanger of claim 1, wherein the vertical suspending member is rigid.

6. The vertically adjustable garment hanger of claim 1, wherein the garment retaining body is triangular.

7. The vertically adjustable garment hanger of claim 1, wherein the supporting hook is configured to rotate 360 degrees with respect to the garment retaining body.

8. The vertically adjustable garment hanger of claim 1, wherein the adjustable support member comprises a spring biased button configured to prevent sliding movement of the adjustable support member along the vertical suspending member when the spring biased button is in a non-depressed position.

9. The vertically adjustable garment hanger of claim 8, wherein the spring biased button is configured to permit sliding movement of the adjustable support member along the vertical suspending member when the spring biased button is in a depressed position.

* * * * *